United States Patent [19]

Jaccodine et al.

[11] Patent Number: 5,043,224

[45] Date of Patent: Aug. 27, 1991

[54] CHEMICALLY ENHANCED THERMAL OXIDATION AND NITRIDATION OF SILICON AND PRODUCTS THEREOF

[75] Inventors: Ralph J. Jaccodine, Allentown; Paul Schmidt, deceased, late of Allentown, both of Pa.; Eva Schmidt, executrix, Binghamton, N.Y.

[73] Assignee: Lehigh University, Bethlehem, Pa.

[21] Appl. No.: 506,589

[22] Filed: Apr. 5, 1990

Related U.S. Application Data

[63] Continuation of Ser. No. 195,352, May 12, 1988, abandoned, which is a continuation of Ser. No. 909,308, Sep. 19, 1986, abandoned, which is a continuation-in-part of Ser. No. 695,317, Mar. 4, 1985, abandoned.

[51] Int. Cl.[5] ..... C23C 26/00

[52] U.S. Cl. ..... 428/446; 428/704; 427/255.3; 437/239; 437/241; 437/242

[58] Field of Search ..... 437/239, 241, 242; 427/255.3; 428/446, 704

[56] References Cited

U.S. PATENT DOCUMENTS

| | | | |
|---|---|---|---|
| 3,607,480 | 9/1971 | Harrp | 437/241 |
| 3,692,571 | 9/1972 | Colton | 437/239 |
| 4,214,919 | 7/1980 | Young | 427/93 |
| 4,300,989 | 11/1981 | Chang | 437/239 |
| 4,567,061 | 1/1986 | Hayashi | 427/93 |

OTHER PUBLICATIONS

Morita et al, "Fluorine-Enhanced Thermal Oxidation of Silicon in the Presence of $NF_3$", Appl. Phys. Letters 45(12), Dec. 15, 1984, pp. 1312-1314.

*Primary Examiner*—S. Beck
*Assistant Examiner*—Vi Duong Dang
*Attorney, Agent, or Firm*—Ratner & Prestia

[57] ABSTRACT

A process for enhanced thermal oxidation and nitridation of silicon by introduction of fluorine into the oxidation and nitridation ambients.

30 Claims, 5 Drawing Sheets

CHEMICALLY ENHANCED THERMAL OXIDATION AND NITRIDATION OF SILICON AND PRODUCTS THEREOF

This application is a continuation of application Ser. No. 195,352 filed May 12, 1988, now abandoned, which application is a continuation of application Ser. No. 909,308, filed Sept. 19, 1986, now abandoned, which is a continuation-in-part of our application Ser. No. 695,317 filed Mar. 4, 1985, abandoned which has common inventorship and is assigned to the same entity as the present application.

BACKGROUND OF THE INVENTION

The oxidation of silicon is a key process in both MOS and bipolar technology since oxides are widely used for gate insulators, oxide masks, and thick field and isolation regions.

A common method of oxidizing silicon is high temperature oxidation However, such high temperature oxidations affect junction motion, change impurity profiles, generate stacking faults and dislocations, and may also increase the possibility of oxide contamination. All of the foregoing effects are considered undesirable, particularly when such processes affect circuitry adhering to one micron design rules.

Several processes have been explored in order to reduce the negative effects of high temperature oxidation. One obvious approach is the reduction of oxidation temperature using such techniques as anodic oxidation (A. K. Vijh, *Oxide and Oxide Films*, Vol. 2, J. W. Diggles, Marcel Dekker, 1963, p. 46), anodic oxidation in an oxygen plasma (J. R. Ligenza, J. Appl. Phys., 36, #9, 2703 (1965)), and pressurized oxidation (L. Katz and L. D. Kimerling, Electrochem Soc., 125, 1680 (1968)). In addition, low temperature chemical deposition techniques (CVD) for production of oxide films have also been explored. In general, however, the electrical quality of deposited oxides is generally unsatisfactory unless a high temperature anneal is employed.

A more successful approach involves the use of low level chemical additives during a standard high temperature oxidation period. In particular, the most common approach involves standard 1 atmosphere dry or steam oxidation with the addition of HCl, $Cl_2$, or TCE ($C_2HCl_3$) to the oxidizing ambient. Originally, these chlorine compounds were introduced as a vapor "getter" to reduce mobile ion contamination within the oxidation furnace. (S. Mayo and W. H. Evans, Electrochem. Soc., 124, 780 (1977)). The use of chlorine additives to the oxidation ambient was particularly successful and has been the topic for many investigations. (R. J. Kriegler, Y. Cheng, D. R. Colton, J. Electrochem. Soc., 119, 388 (1972); R. J. Kriegler, *Semiconductor Silicon* 1973. ed. Huff and R. Burgess, Electrochem. Soc., p. 363 (1973); R. J. Kriegler, Thin Solid Films, 13, 11 (1972))

In addition to the passivation of ionic sodium, addition of chlorine to the oxidation ambient has been reported to improve the lifetime of the underlaying silicon (D. R. Young and C. M. Osburn, J. Electrochem. Soc., 120, 1578 (1973)) and also results in improved oxide breakdown strength. (C. M. Osburn, J. Electrochem Soc., 129, 809 (1974)). Because of the importance of the chlorine enhanced oxidation process in MOS technology, it has been thoroughly studied. The relationship between chlorine content and sodium ion passivation has been investigated (A. Rohatgi, S. R. Butler, and F. J. Feigl, J. Electrochem. Soc., 126, 149 (1979)). Furthermore, it has been noted that the addition of chlorine to the oxidation ambient increased the oxidation rate under dry conditions. Specifically, rate enhancements of about 30% for up to 10% added HCl and approximately 60% for 2.5% added $Cl_2$ (over the rate for standard dry $O_2$).

It is known that the addition of chlorine to the oxidation ambient has many adverse effects. Particularly, small amounts of water causes a loss of effective partial pressure of chlorine in the system. (R. J. Kriegler and Denki Kogaku, 41, 466 (1971); K. Ehara, K. Sakmara, and K. Ohwada, Elec. Soc., 120, 526 (1973)) Also, in commonly employed chlorine concentrations, a chlorine rich phase has been shown to develop at the Si/-$SiO_2$ interface. This process eventually degrades oxide adhesion (J. Monkowsi, et al, J. Electrochem. Soc., 125, 1867 (1978); S. L. Titcomb and F. J. Feigl, Electrical Properties of HCl Oxides, presented at ISSC 1982 San Diego.

For the production of thin (<100 Å) gate insulators, silicon nitride possesses superior properties including a higher dielectric constant, superior breakdown strength, and better electrical uniformity than silicon dioxide. Prior art silicon nitride films grown by thermal nitridation techniques, however, were highly contaminated with oxygen. (Ito, et al. *J. Electrochem. Soc.*, 125 448 (1978).)

Thicker films having higher nitrogen content have been produced in $NH_3$ nitridation ambients instead of $N_2$ ambients by employing elevated temperatures. These films, however, appear not to grow significantly thicker with increasing nitridation time. Finally, plasma nitridations have been practiced, with mixed results.

Finally, a number of practical problems are associated with chlorine addition to the oxidation ambient. These include the highly corrosive nature of the ambient vapors which makes heavy demands on corrosion resistance of equipment, and exhaust facilities. Furthermore, the environmental effects of exhausting such vapors can be extremely serious.

It has been observed by various investigators that the addition of fluorine ions to wet anodization baths for silicon and to oxygen or nitrogen plasmas can result in enhanced rates of oxidation. (P. F. Schmidt and W. Michel, J. Electrochem. Soc., 104, 230 (1957); M. Croset and D. Dieremegard, J. Electrochem. Soc., 120, 426 (1973); R. P. H. Chang, C. C. Chang, and S. Dorack, Appl. Phys. Lett. 36, 999 (1981))

BRIEF DESCRIPTION OF THE INVENTION

The present invention comprises a process for the oxidation or nitridation of silicon and the oxide and nitride produced therefrom. The addition of very low concentrations of fluorine-containing compounds to thermal oxidation or nitridation ambients is shown to enhance oxide or nitride layer growth rates and provide superior electronic properties to those obtainable using conventional oxidation or nitridation ambients including only chlorine-bearing species.

DETAILED DESCRIPTION OF THE INVENTION

Figure 1:
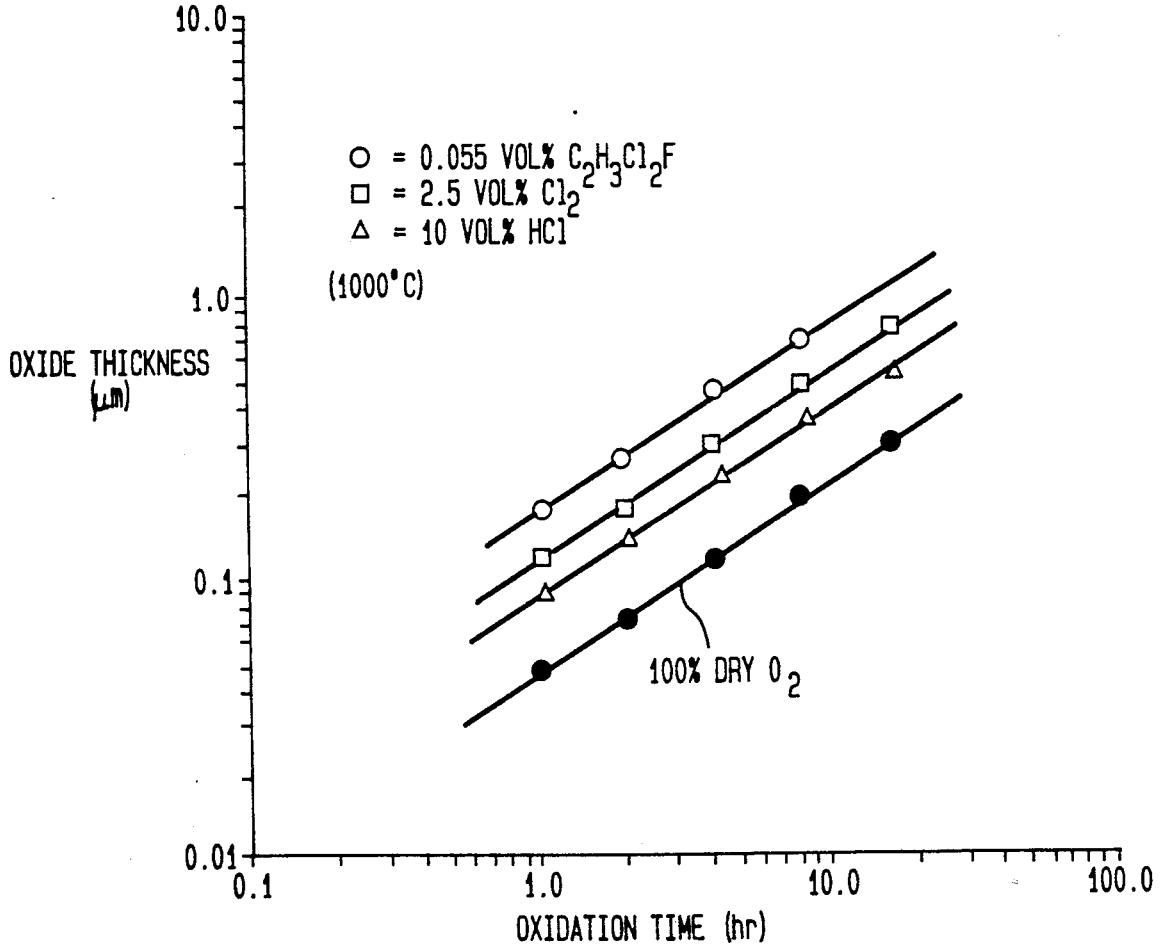
FIG. 1 is a graph which plots oxide layer thickness against oxidation time for the oxidation of lightly doped silicon in various gas ambients at 1000° C.

Typically, conventionally grown silicon wafers which have been chem-mechanically polished and given a standard semiconductor cleaning with a dilute HF etch and deionized water rinse are subjected to oxidation in a well-baffled furnace at temperatures from 700°-1000° C. for times of 1 to 12 hours.

In a typical oxidation, wafers are inserted into a 3-inch furnace tube under flowing $N_2$. The ambient is then switched to the oxidant supply at a flow rate of 1 l/min dry $O_2$ mixed. In accordance with the present invention, the oxidant supply also includes 1-10 ml/min of the same $O_2$ which has been first bubbled through an appropriate liquid source of fluorine. Alternatively, gaseous fluorine compounds may be directly injected. An example of a liquid fluorine source is the liquid 1,2-dichlorofluoroethane. As used in the claims, fluorine includes any compound which may be used to introduce F atoms into the reactive ambient.

Similar processes may be employed for a thermal nitridation by adding $NF_3$ to flowing nitrogen or ammonia ambient. The growth of such nitrides and their qualities are similarly enhanced by the presence of fluorine in the ambient.

Suitable sources of fluorine for the oxidation include $NF_3$, the dichloro-difluoro ethanes, chlorine containing freons, and fluorine containing freons, such as freon 14, freon 22, freon 116, freon 114, and the fluoro form of freon 23. In addition, many other fluorine-bearing alkyls may be used. Such compounds should be selected on the basis of appropriate vapor pressures and boiling point as well as the amount of fluorine contained within the molecule.

Acceptable concentrations of fluorine for use in the present invention range from trace amounts up to about 0.2 mol % atomic fluorine. These concentrations are 2 orders of magnitude below those necessary when chlorine is the sole additive to the oxidation ambient.

Oxide and nitride layer growth rates and qualities are dependent on a wide variety of process variables. Among these are temperature, ambient flow rate, partial pressures of $H_2O$, $O_2$, $N_2$, F, and other elements at the Si surface, furnace type and geometry, and preprocessing treatment of the wafer. These parameters are interrelated and temperature ranges of 600°-1200° C. with F concentrations of trace amounts to 0.2 mol % may be employed.

In certain applications, the present inventors have found that use of fluorine sources having no chlorine in their structures produces better results (e.g. faster growth and better electronic properties of the grown layer). Similarly, fluorine source compounds having no hydrogen in their structures may also give superior performance when employed in the process of the present invention.

The present inventors have noted a degradation of oxide quality when fluorine concentrations exceed about 0.2 mol % in the oxidation ambient and/or when the oxidation temperature is high. Such oxides grown at high concentrations have a density of pin holes and appear to be "spongy".

Preliminary characterization of both the oxides and nitrides grown according to the present invention by one of the inventors herein, indicate superior electrical characteristics to those obtainable in conventional chlorine-enhanced oxidations.

The following examples demonstrate the salient features of the present invention:

EXAMPLE 1

A series of chem-mechanically polished p-type Czochralski-grown wafers of (100) orientation, in the 2-10 ohm/cm range, were standard semiconductor cleaning with a diluted HF etch and deionized water rinse to remove any residual oxides.

Oxidations were carried out at temperatures from 700°-1000° C. for times of 1-12 hours in a well-baffled oxidation furnace. Dry $O_2$ oxidations at 0% vol addition of fluorine compound were used as controls. The input oxidant was composed of 1 l/min dry $O_2$ along with 1-10 ml/min of the same $O_2$ bubbled through liquid 1,2-dichlorofluoroethane at 25° C.

Oxides were grown by inserting the wafers into the furnace tube in flowing $N_2$ and then switching over to the oxidant supply. Measurements of thickness and index of refraction were made using a Rudolph ellipsometer with a helium-laser source at 632.8 nm wave length In addition, oxide etch rate was measured in buffered HF and the product was inspected for pin holes.

A series of oxides were grown at temperatures of 700°, 800°, 900°, and 1000° C. at times of 1, 2, 4, 8, and 12 hours in dry $O_2$ with additive flows of 0, 1, 5, and 10 ml/min through the liquid source at 25° C. Under these conditions, concentrations of fluorine in the ambient were 0, 0.011, 0.055, and 0.11 mol %. The oxides grown with fluorine addition had approximately the same physical characteristics, etch rate and index of refraction as those grown under dry $O_2$. Only the oxides grown at 1000° C. and 0.11 mol % fluorine addition deviated from these results with that oxide displaying a high density of pin holes.

Referring now to FIG. 1, there is shown a plot of oxide thickness versus oxidation time for oxidations at 1000° C. with 0.055 mol % fluorine addition. Comparable data are also plotted for 10 vol % HCl (comparable to the work of D. W. Hess and B. E. Deal, J. Electrochem. Soc., 124 (1977) 58) and also comparable to a 3 vol % addition of $Cl_2$ (B. E. Deal, D. W. Hess, J. D. Plummer, and C. P. Ho, J. Electrochem. Soc., 125 (1978) 339). From FIG. 1, it can be appreciated that under comparable conditions, the growth rate of $SiO_2$ in a fluorine-containing ambient is enhanced by approximately 2 orders of magnitude over those oxides grown with only chlorine additions.

Figure 2:
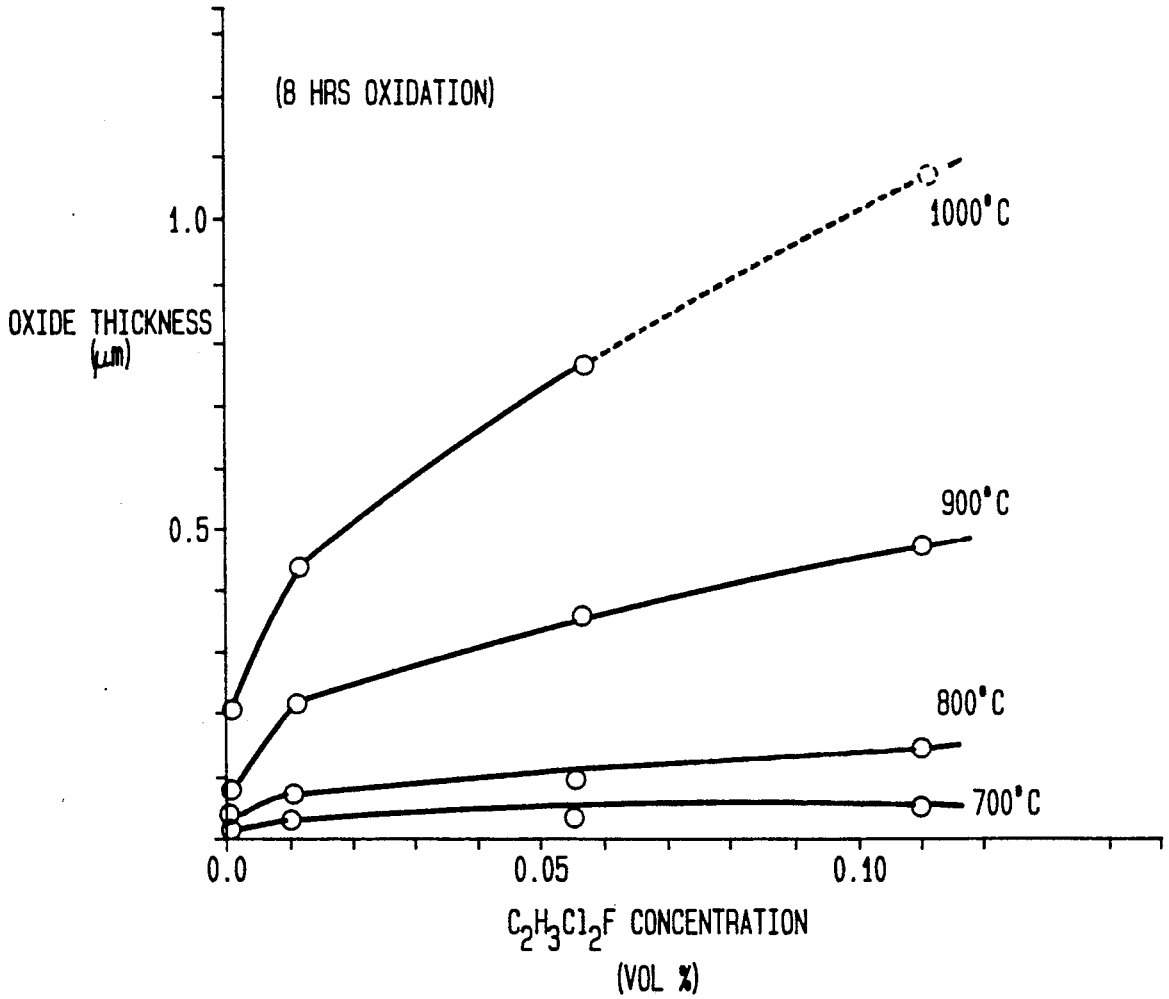
FIG. 2 is a graph which plots oxide thickness against 1,2-dichlorofluoroethane concentration in volume percent for the oxidation of silicon at various temperatures for 8 hours.

Referring now to FIG. 2, there is shown a plot of data for the 8 hour oxidations at temperatures from 700°-1000° C. as a function of $C_2H_3Cl_2F$ concentrations from 0 to 0.11 vol % (0-0.11 mol % F). It can be seen that as the additive concentration of fluorine is increased, the oxide thickness also increases. This relative increase due to the addition of fluorine appears to be insensitive to oxidizing temperature.

Figure 3:
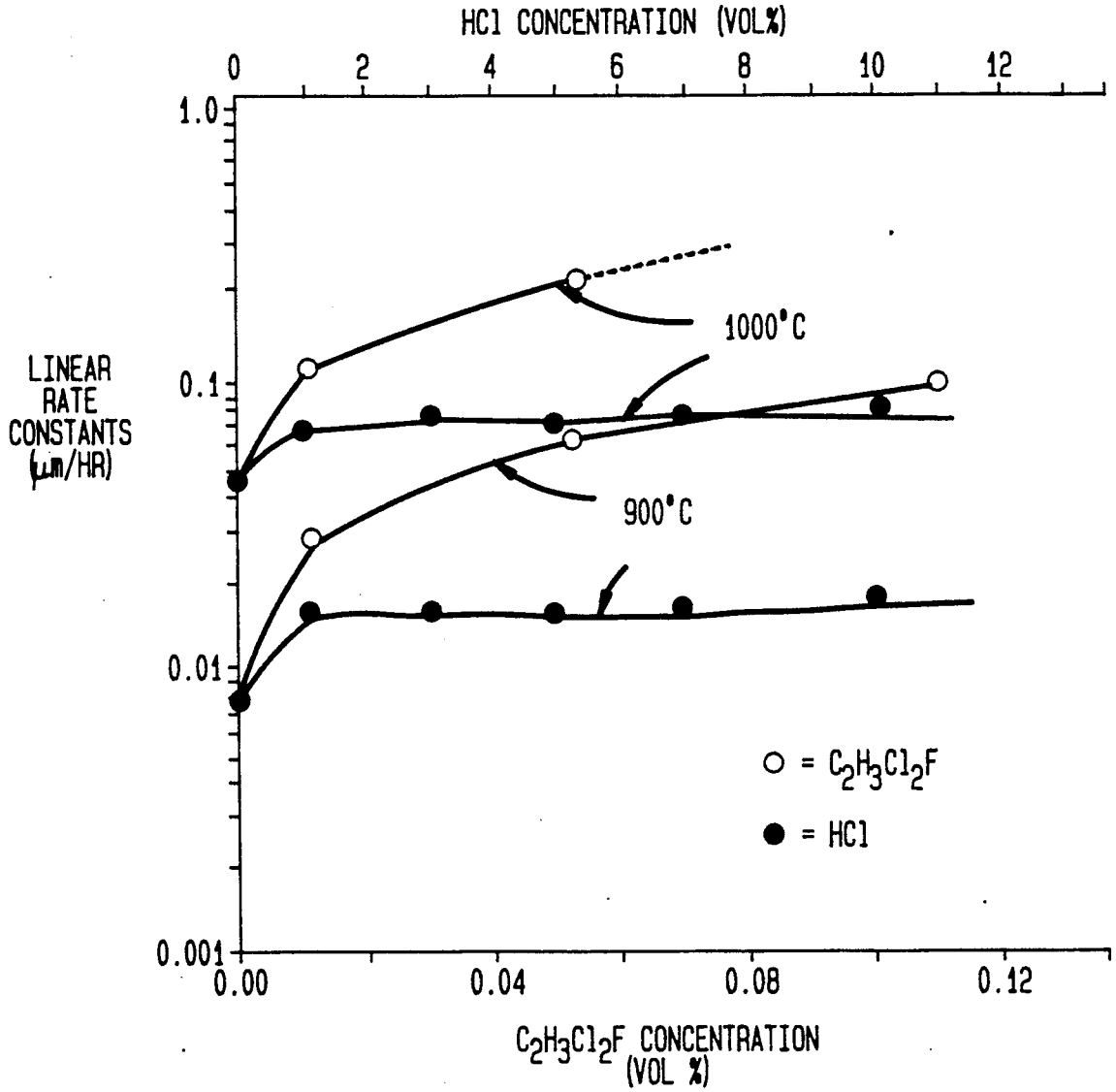
FIG. 3 is a graph plotting the linear rate constant against the volume percent 1,2-dichlorofluoroethane and HCl in oxygen for the oxidation of lightly doped silicon.

Using the Deal-Grove method (B. E. Deal and A. S., Grove, J. Appl. Phys. 36 (1965) 3770), the inventors herein analyzed the oxidation data of oxide thickness versus oxidation time to determine the linear and parabolic rate constants. FIG. 3 is the resultant plot of linear rate constant (B/A in um/hr) versus vol % of $C_2H_3Cl_2F$ (mol % F). The data have been plotted for the 900° and 1000° C. oxidations so as to be comparable with similar data obtained by Hess and Deal using HCl as the additive. It will be observed that the constants for fluorine oxidations are larger than those for HCl oxidations having HCl concentrations 2 orders of magnitude greater.

Figure 4:
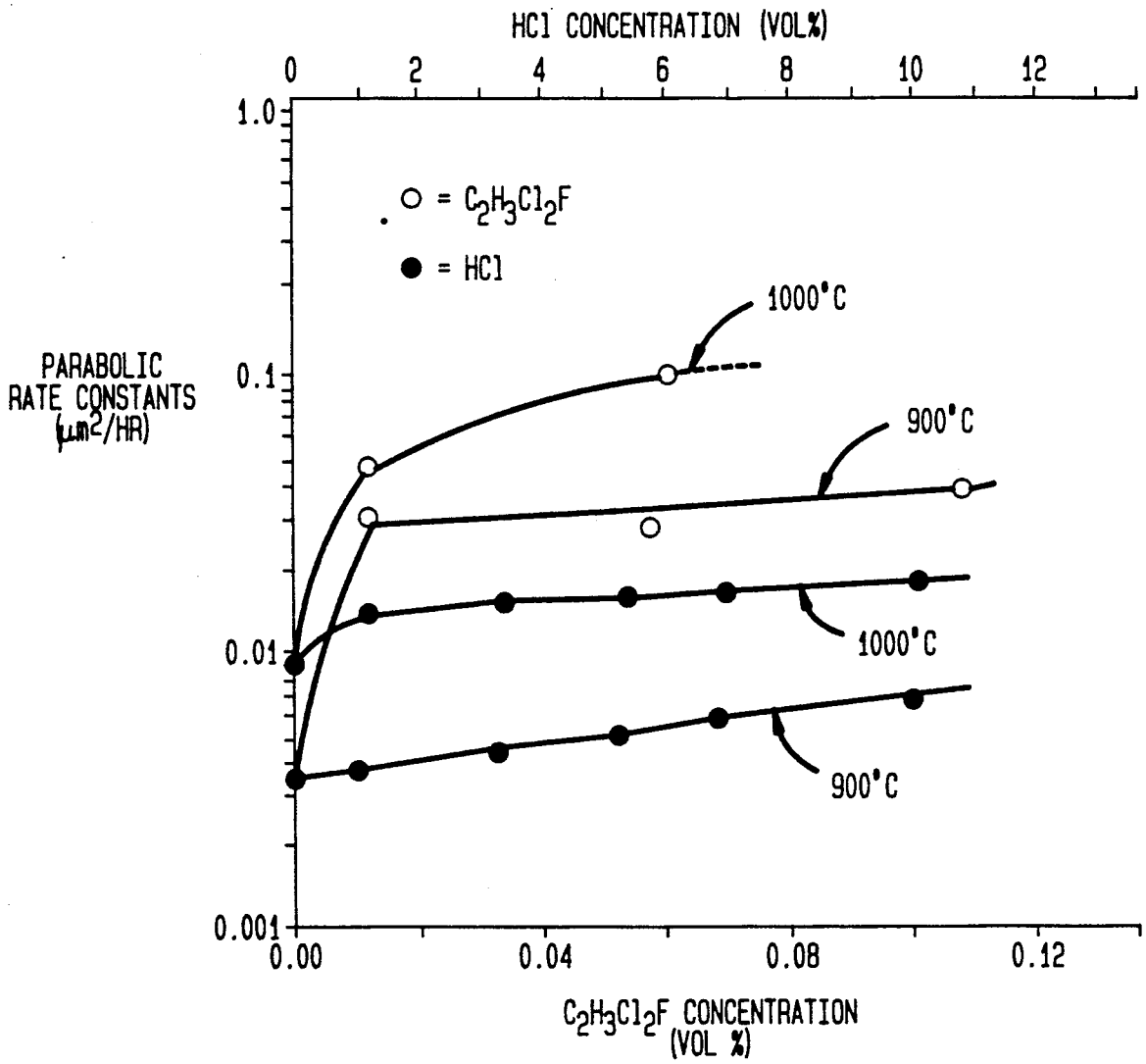
FIG. 4 is a graph plotting the parabolic rate constant against volume percent 1,2-dichlorofluoroethane and HCl in oxygen for the oxidation of lightly doped silicon.

Referring now to FIG. 4, the parabolic rate constant (B in $um^2/hr$) versus vol % $C_2H_3Cl_2F$ (mol % F) is shown Again, the results indicate that this rate constant is much larger than those obtainable in HCl additive oxidations even at very low concentrations of fluorine.

EXAMPLE 2

Similar investigations to those detailed in Example 1 were formed on lightly doped p-type (100) and (111) wafers. These were oxidized at 800° C. with 0.11 mol % F addition. Orientation effects were noted with the (111) silicon oxidizing faster than the (100) silicon with a ratio of about 1.4.

EXAMPLE 3

The enhanced nitridation of silicon was carried out at 1000° C. for 8 hours in a nitridation ambient of $N_2$ containing various concentrations of $NF_3$. Nitridation flow was 1 l/min $N_2$ at 20 psi. Thicknesses of grown layer were determined by ellipsometric measurements assuming a refractive index of 2.00 for the silicon nitride layer. However, it is possible that the layer grown may not be a stoichiometric silicon nitride, but may contain some alternative silicon structures as well as nitrides. Table 1 lists the thickness enhancement which resulted from the addition of fluorine to the nitridation ambient.

TABLE I

THICKNESS ENHANCEMENT WITH $NF_3$ IN $N_2$

| Temperature | Duration | Fluorine Addition | Thickness |
|---|---|---|---|
| 1000° C. | 8 hr | 0.000% $NF_3$ | 67 Å |
| 1000° C. | 8 hr | 0.011% $NF_3$ | 97 Å |
| 1000° C. | 8 hr | 0.044% $NF_3$ | 178 Å |

EXAMPLE 4

N-type (100) silicon wafers were given a standard Piranha cleaning for 30 minutes and then inserted into an $N_2$-purged oxidation furnace in a 3 lpm flow of $N_2$. This flow was continued for 15 minutes while the wafers came to temperature. The flow was then changed to a mixture of 70% $N_2$, 30% $NH_3$ at 2 lpm which was maintained for either 2, 4, or 8 hours at furnace temperatures of from 1000°-1200° C. $NF_3$ was added to the ambient at concentrations ranging from 0-200 ppm.

After nitridation, the furnace was purged with pure $N_2$ at 3 lpm flow.

Figure 5:
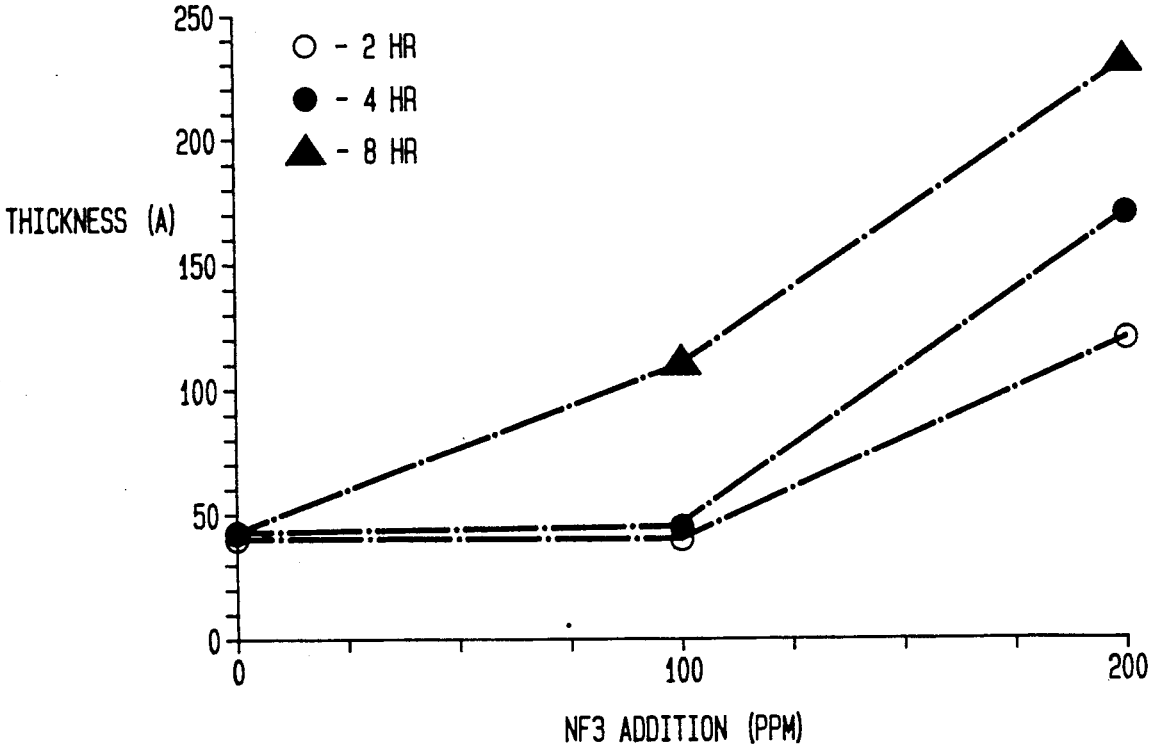
FIG. 5 is a graph plotting the nitride layer thickness against $NF_3$ concentrations in 2-, 4-, and 8-hour nitridations at 1000° C.

Referring now to FIG. 5, there is shown a plot relating nitride film thickness to $NF_3$ concentrations for 2-, 4- and 8-hour nitridation runs. The figure illustrates the marked benefits of F introduction into the nitridation ambient.

Other analyses conducted by the present inventors indicate that the nitrogen content of the nitride films of the present invention is higher than those of the prior art and that, contrary to the teachings of the prior art, the best film thickness and quality are achieved at lower temperatures and longer times.

From these examples and like information from other experiments, it seems clear that the introduction of only a very small proportion of a fluorine-containing compound into oxidation or nitridation ambients results in a dramatic and surprising enhancement of the growth rate of an oxide or nitride layer on a silicon surface. While this invention has been described with reference to specific examples, it will be understood by those skilled in the art that the scope of the invention as defined by the appended claims permits other combinations than those detailed above. Such alternative embodiments are understood to encompass the present invention as defined in the following claims:

We claim:

1. In a process for growing an oxide or nitride surface layer on a silicon substrate by heating said substrate to a temperature adapted to provide optimal growth rates, thicknesses, and electronic qualities of the oxide or nitride film, and exposing said substrate to a reactive gas consisting essentially of oxygen or nitrogen for a period sufficient to form a layer of desired thickness by reaction between said substrate and said gas, the improvement comprising including in said reactive gas less than 0.2 mol % (measured as F) of a fluorine-containing reactant.

2. The process of claim 1 wherein said fluorine-containing reactant is a chloro-fluoro-hydrocarbon.

3. The process of claim 2 wherein said chloro-fluoro-hydrocarbon is selected from the group of: chlorofluoroethane, dichlorofluoroethane, dichlorodifluoroethane, trichlorofluoroethane, chlorotrifluoroethane, chlorodifluoroethane, Freon 14, Freon 22, Freon 116, Freon 114, and the fluoro of Freon 23.

4. The process of claim 1 wherein said fluorine-containing reactant is a fluorine-bearing hydrocarbon or freon not containing chlorine.

5. The process of claim 1 wherein said fluorine-containing reactant contains no chlorine or hydrogen.

6. The process of claim 5 wherein said fluorine-containing reactant is $NF_3$.

7. The process of claim 5 wherein said oxidizing atmosphere is formed by evaporating said fluorine source into dry gaseous oxygen and mixing the resultant gas with additional dry oxygen gas to achieve a predetermined fluorine concentration.

8. An oxidized silicon surface material produced in accordance with the process of claim 5.

9. An oxidized or nitridized silicon surface material produced in accordance with the process of claim 4.

10. A process for growing an oxide layer on a silicon surface comprising the steps of:

a. heating unoxidized silicon to a temperature adapted to provide optimal growth rates, thicknesses, and electronic qualities of the oxide film under an inert atmosphere;

b. substituting an oxidizing atmosphere for said inert atmosphere, said oxidizing atmosphere comprising principally oxygen but also comprising up to 0.2 mol % fluorine (measured as F) from a fluorine source comprising $NF_3$, fluorine-bearing freons, chlorofluoroethane, dichlorofluoroethane, dichlorodifluoroethane, trichlorofluoroethane, chlorotrifluoroethane, chlorodifluoroethane, Freon 14, Freon 22, Freon 116, Freon 114, and the fluoro form of Freon 23; and c. allowing said oxidizing atmosphere to oxidize said silicon for a predetermined period of time.

11. In a process for growing an oxide or nitride surface layer on a silicon substrate by heating said substrate to a temperature adapted to provide optimal growth rates, thicknesses, and electronic qualities of the oxide or nitride film, and exposing said substrate to a reactive gas consisting essentially of oxygen or nitrogen for a period sufficient to form a layer of desired thickness by reaction between said substrate and said gas, the improvement comprising including in said reactive gas between 0.055 and 0.20 mol % fluorine (measured as F) of a fluorine-containing reactant.

12. The process of claim 11 wherein said fluorine-containing reactant is a chloro-fluoro-hydrocarbon.

13. The process of claim 12 wherein said chloro-fluoro-hydrocarbon is selected from the group of: chlorofluoroethane, dichlorofluoroethane, dichlorodifluoroethane, trichlorofluoroethane, chlorotrifluoroethane, chlorodifluorethane, Freon 14, Freon 22, Freon 116, Freon 114, and the fluoro form of Freon 23.

14. The process of claim 11 wherein said fluorine-containing reactant is a fluorine-bearing hydrocarbon or freon not containing chlorine.

15. The process of claim 11 wherein said fluorine-containing reactant contains no chlorine or hydrogen.

16. The process of claim 15 wherein said fluorine-containing reactant is $NF_3$.

17. The process of claim 15 wherein said oxidizing atmosphere is formed by evaporating said fluorine source into dried gaseous oxygen and mixing the resultant gas with additional dry oxygen gas to achieve a predetermined fluorine concentration.

18. An oxidized silicon surface material produced in accordance with the process of claim 15.

19. An oxidized or nitridized silicon surface material produced in accordance with the process of claim 14.

20. A process for growing an oxide layer on a silicon surface comprising the steps of:

a. heating unoxidized silicon to a temperature adapted to provide optimal growth rates, thicknesses, and electronic qualities of the oxide film under an inert atmosphere;

b. substituting an oxidizing atmosphere for said inert atmosphere, said oxidizing atmosphere comprising principally oxygen but also comprising between 0.055 and 0.2 mol % fluorine (measured as F) from a fluorine source comprising $NF_3$, fluorine-bearing freons, chlorofluoroethane, dichlorofluoroethane, dichlorodifluoroethane, trichlorofluoroethane, chlorotrifluoroethane, chlorodifluoroethane, Freon 14, Freon 22, Freon 116, Freon 114, and the fluoro from of Freon 23; and c. allowing said oxidizing atmosphere to oxidize said silicon for a predetermined period of time.

21. In a process for growing an oxide or nitride surface layer on a silicon substrate by heating said substrate to a temperature adapted to provide optimal growth rates, thicknesses, and electronic qualities of the oxide or nitride film, and exposing said substrate to a reactive gas consisting essentially of oxygen or nitrogen for a period sufficient to form a layer of desired thickness by reaction between said substrate and said gas, the improvement comprising including in said reactive gas between 0.055 and 0.11 mol % fluorine (measured as F) of a fluorine-containing reactant.

22. The process of claim 21 wherein said fluorine-containing reactant is a chloro-fluoro-hydrocarbon.

23. The process of claim 22 wherein said chloro-fluoro-hydrocarbon is selected from the group of: chlorofluoroethane, dichlorofluoroethane, dichlorodifluoroethane, trichlorofluoroethane, chlorotrifluoroethane, chlorodifluorethane, Freon 14, Freon 22, Freon 116, Freon 114, and the fluoro form of Freon 23.

24. The process of claim 21 wherein said fluorine-containing reactant is a fluorine-bearing hydrocarbon or freon not containing chlorine.

25. The process of claim 21 wherein said fluorine-containing reactant contains no chlorine or hydrogen.

26. The process of claim 25 wherein said fluorine-containing reactant is $NF_3$.

27. A process for growing an oxide layer on a silicon surface comprising the steps of:

a. heating unoxidized silicon to a temperature adapted to provide optimal growth rates, thicknesses, and electronic qualities of the oxide film under an inert atmosphere;

b. substituting an oxidizing atmosphere for said inert atmosphere, said oxidizing atmosphere comprising principally oxygen but also comprising between 0.055 and 0.11 mol % fluorine (measured as F) from a fluorine source comprising $NF_3$, fluorine-bearing freons, chlorofluoroethane, trichlorofluoroethane, chlorotrifluoroethane, chlorodifluoroethane, Freon 14, Freon 22, Freon 116, Freon 114, and the fluoro form of Freon 23; and c. allowing said oxidizing atmosphere to oxidize said silicon for a predetermined period of time.

28. The process of claim 25 wherein said oxidizing atmosphere is formed by evaporating said fluorine source into dried gaseous oxygen and mixing the resultant gas with additional dry oxygen gas to achieve a predetermined fluorine concentration.

29. An oxidized silicon surface material produced in accordance with the process of claim 25.

30. An oxidized or nitridized silicon surface material produced in accordance with the process of claim 24.

* * * * *